US011285729B2

(12) United States Patent
Gardner et al.

(10) Patent No.: US 11,285,729 B2
(45) Date of Patent: Mar. 29, 2022

(54) PRINT MATERIAL LEVEL SENSING

(71) Applicant: Hewlett-Packard Development Company, L.P., Spring, TX (US)

(72) Inventors: James Michael Gardner, Corvallis, OR (US); Daryl E Anderson, Corvallis, OR (US); Evan Clay Dagg, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/769,043

(22) PCT Filed: Apr. 5, 2019

(86) PCT No.: PCT/US2019/026091
§ 371 (c)(1),
(2) Date: Jun. 2, 2020

(87) PCT Pub. No.: WO2020/204943
PCT Pub. Date: Oct. 8, 2020

(65) Prior Publication Data

US 2022/0048297 A1 Feb. 17, 2022

(51) Int. Cl.
*B41J 2/175* (2006.01)

(52) U.S. Cl.
CPC .. *B41J 2/17566* (2013.01); *B41J 2002/17579* (2013.01)

(58) Field of Classification Search
CPC .... B41J 2/0458; B41J 2/0451; B41J 2/14153; B41J 2/04555; B41J 2/125; B41J 2/17566; B41J 2002/17579
See application file for complete search history.

(56) References Cited

U.S. PATENT DOCUMENTS

| | | | | |
|---|---|---|---|---|
| 8,024,968 | B2 | 9/2011 | Sabanovic et al. | |
| 8,562,091 | B2 | 10/2013 | Sabanovic et al. | |
| 9,925,787 | B2 | 3/2018 | Van Brocklin et al. | |
| 10,940,694 | B2 * | 3/2021 | Anderson | B41J 2/17503 |
| 2021/0276337 | A1 * | 9/2021 | Studer | B41J 2/17566 |

FOREIGN PATENT DOCUMENTS

| | | | |
|---|---|---|---|
| JP | 2002091175 | A | 3/2002 |
| JP | 2003285451 | A | 10/2003 |
| JP | 2009234221 | A | 10/2009 |

(Continued)

*Primary Examiner* — An H Do
(74) *Attorney, Agent, or Firm* — HP Inc. Patent Department

(57) ABSTRACT

A print material level sensor includes a power node to receive electrical power and a series of print material level sensing devices to receive electrical power from the power node. The print material level sensing devices are disposed at intervals to detect the presence of a print material at successive depth zones in a container. Each print material level sensing device includes a heater to emit heat at its depth zone and a sensor to sense heat at the depth zone. The sensor has control circuitry to turn on the heater of a first print material level sensing device at a first depth zone for a first time duration during the sensing of the first depth zone and to turn on the heater of a second print material level sensing device at a second depth zone for a second time duration during the sensing of the second depth zone.

20 Claims, 12 Drawing Sheets

(56) References Cited

FOREIGN PATENT DOCUMENTS

| | | | |
|---|---|---|---|
| WO | WO-2017074342 | A1 | 5/2017 |
| WO | WO-2017184143 | A1 | 10/2017 |
| WO | WO-2017184147 | A1 | 10/2017 |
| WO | WO-2017189011 | A1 | 11/2017 |
| WO | WO-2018017095 | A1 | 1/2018 |

* cited by examiner

| Sensing Device | Time Duration |
|---|---|
| 0 | a |
| 1 | b |
| 2 | c |
| 3 | d |
| ... | ... |
| ... | ... |
| N | ... |

FIG. 5

PRINT MATERIAL LEVEL SENSING

CROSS-REFERENCE TO RELATED APPLICATION

Pursuant to 35 U.S.C. § 371, this application is a United States National Stage Application of PCT Patent Application Serial No. PCT/US2019/026091, filed on Apr. 5, 2019, the contents of which are incorporated by reference as if set forth in their entirety herein.

BACKGROUND

Printing devices eject print material to form an image or structure. The print material may be stored in a container from which it is drawn by the printing device for ejection. Over time, the level of print material in the container is reduced. A print material level sensor is useful to determine a current level of print material.

BRIEF DESCRIPTION OF DRAWINGS

Examples will now be described, by way of non-limiting example, with reference to the accompanying drawings, in which:

FIG. 5 shows an example look-up table;

DETAILED DESCRIPTION

Figure 1:
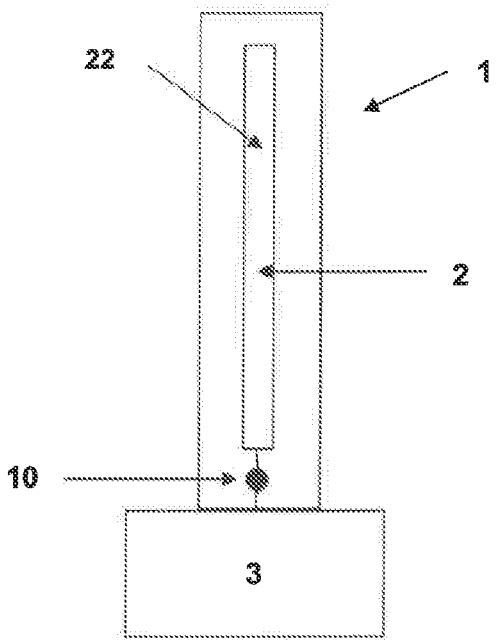
FIG. 1 shows an example print material level sensor.

FIG. 1 shows an example print material level sensor 1. The example print material level sensor 1 includes a series 2 of print material level sensing devices and control circuitry 3. The series of print material level sensing devices 2 receive electrical power from a node 10. The node 10 receives the electrical power from a power source.

Figure 2:
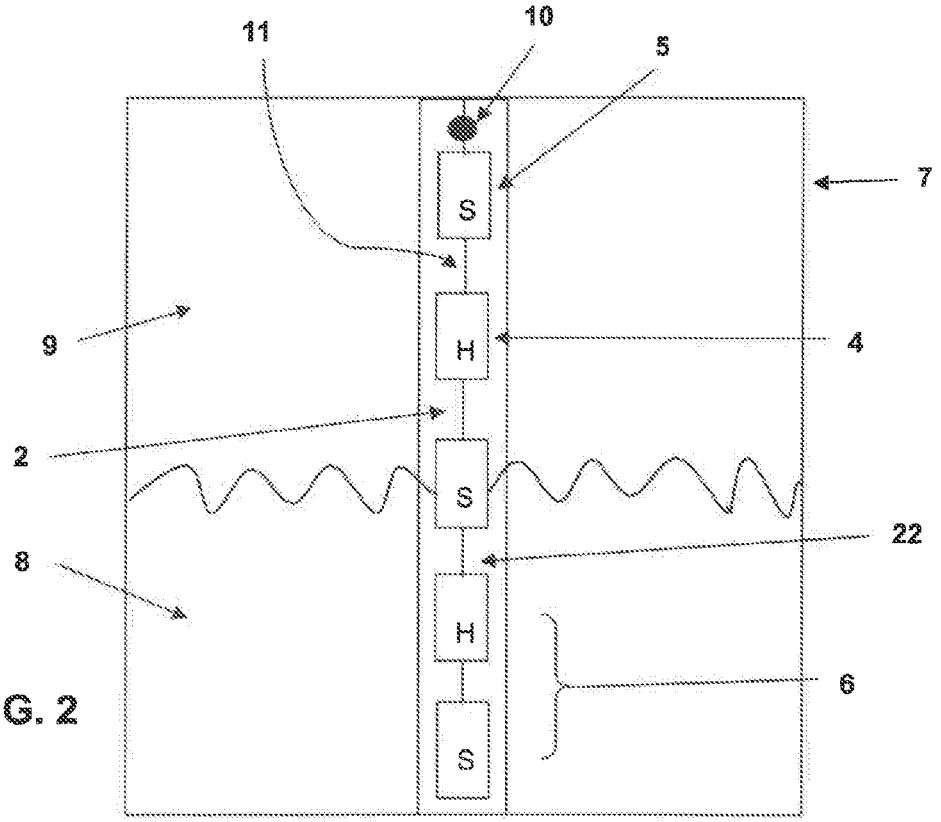
FIG. 2 shows an example series of print material level sensing devices.

FIG. 2 shows an example of part of a series 2 of print material level sensing devices. In the example of FIG. 2, a pair of a heater 4 and a sensor 5 form a print material level sensing device 6. In this way, the series of print material level sensing devices are disposed at intervals to detect presence of the print material at successive depth zones within a volume 7. The volume 7 is shown partially filled with a print material 8. The remainder of the volume may be filled with a gas such as air 9. The extent to which the volume is filled by the print material will vary over time as print material is used in printing by a printing device. The extent to which the volume is filled will also change if the print material in the volume is replenished. Example print materials may include any of ink, for example dye based ink or pigment based ink, fixer, for example to bind ink, a primer, for example for an undercoating, a finish, for example for a coating, a fusing agent, for example for use in three-dimensional printing, and a detailing agent, for example for use in three-dimensional printing. Also, suitable print materials may for example include materials which can be titrated for use in life sciences applications.

The heater 4 of a print material level sensing device 6 emits heat at its depth zone and the sensor 5 senses heat at the depth zone to output a signal based on the heat sensed. The sensor 5 is sufficiently close to the heater 4 to sense heat when the heater is emitting heat. Wiring 11 enables to supply electrical power to the heaters 4 in the series 2 from a node 10.

Control circuitry 3 enables to turn on the heater of a first print material level sensing device at a first depth zone for a first time duration during the sensing of the first depth zone and to turn on the heater of a second print material level sensing device at a second depth zone, further from the power node than the first depth zone, for a second time duration longer than the first time duration during the sensing of the second depth zone. In one example, the second print material level sensing device may be adjacent to the first print material level sensing device. In the example of FIG. 2 the heater shown further from the node 10, i.e. the heater depicted in the print material 8 in the example of FIG. 2, is turned on for a longer time duration than the heater shown closer to the node 10, i.e. the heater depicted above the print material 8 in the example of FIG. 2.

In one example, the control circuitry 3 may turn on the heater of a third print material level sensing device at a third depth zone, further from the power node than the second depth zone, for a third time duration longer than the second time duration during the sensing of the third depth zone.

By heating a heater further from the node 10 for a longer time duration during sensing of its depth zone than a heater closer to the node 10 during sensing of its depth zone, measurement to determine whether print material is present at each depth zone can be performed consistently irrespective of whether a depth zone is closer to or further from a power node, and hence power source, by which the heaters are powered is being sensed.

Figure 3:
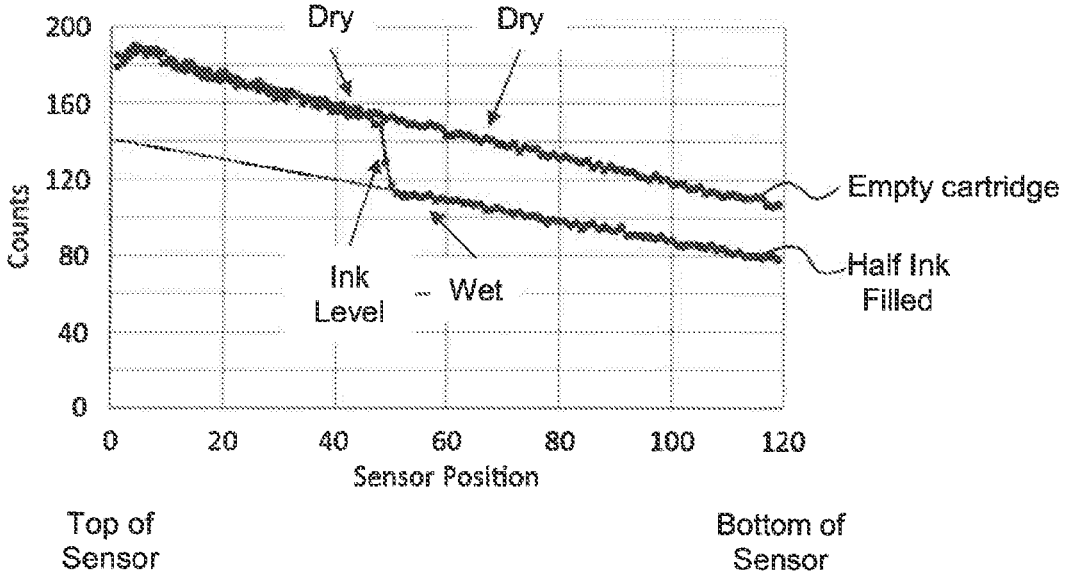
FIG. 3 shows measurement results of ink level sensing.

This is explained further with reference to FIG. 3. FIG. 3 shows measurement results from sensor 0 to sensor 120 of a series of print material level sensing devices. The data of FIG. 3 was, in contrast to the description above, obtained by heating each heater for a same predetermined amount of time. The sensors are plotted along the x axis from the sensor 0 at a top position to the sensor 120 at a bottom position. In this arrangement, the sensor 0, and its associated heater, heater 0, is closest to the power source powering the heaters. The sensor 120, and its associated heater, heater 120, is furthest from the power source powering the heaters. The y axis shows a measured value of the signal output by each sensor. In the example of FIG. 3, the measured value is obtained from the sensor by turning on its associated heater for the predetermined amount of time, turning off the heater, waiting for a fixed delay amount to expire, and then measuring the signal.

In FIG. 3, the upper line of results are when air is present around all of the sensors from sensor 0 at the top to sensor 120 at the bottom. In other words, the container is empty and no print material is present. The lower line of results are when print material, in this example ink, is present from the bottom sensor 120 up to around sensor 50. Above around sensor 50, i.e. from there up to sensor 0, air is present. The step change in the lower line of results shows the transition from print material to air. It therefore shows the level, hence the amount, of print material present in the container.

It can further be seen from FIG. 3 that the upper line of results has a slope from the sensor 0 position at the left-hand side of the graph to the sensor 120 position at the right-hand side of the graph. For the sensor 0 a measured count value of over 180 is measured whereas for the sensor 120 a measured count value of over 100 is measured. Thus, the measured value decreases as the sensor position becomes further from the top and closer to the bottom.

The lower line of results demonstrates a similar slope, both in the region at which air is present and in the region in which print material is present. The dashed line shows how the slope in the region in which print material is present would continue if print material were to be present all the way up to the sensor 0 position. It can be seen that the difference in measured value depending on which of air and print material is present at the sensor 0 position is significantly higher than the difference in measured value depending on which of air and print material is present at the sensor 120 position. The sensitivity with which the presence of air and print material can be determined is therefore greater at the sensor 0 position than at the sensor 120 position.

It has been determined by the inventors that the decrease in measured value is due to parasitic voltage drops suffered by the heaters of the print material level sensing devices as the distance from the power source increases. The narrow carrier on which the series of print material level sensing devices may be provided and the narrow wiring that transmits electrical power to the print material level sensing devices from the node contribute to the parasitic voltage drops. As a result of the parasitic voltage drops, heaters further away from the power source receive less power in a given amount of time than heaters closer to the node and hence to the power source. A cause of the parasitic voltage drop in the wiring is the narrowness of the wiring and the thickness it can be fabricated to. In other words, the wiring having a width much smaller than its length. For a heater further from the power source the length of the wiring is greater than for a heater closer to the power source and hence the parasitic voltage drop is greater. The wiring may for example be in the form of metal traces, such as thin film metal traces, that transmit power from the power source to the heaters. The metal traces may be formed on the carrier by a silicon CMOS fabrication process. The metal traces may for example comprise aluminium. As an example, a metal trace may have a width of no greater than 100 μm and a length of at least 10,000 μm.

In contrast to the measurement results shown in FIG. 3, the example arrangement described above in which a heater further from the node is supplied with electrical power for a longer time duration than a heater closer to the node, enables to ensure that measurement can be performed from a same or similar starting temperature at each print material level sensing device irrespective of the depth zone at which the print material level sensing device is located. A same or similar sensitivity can thereby be achieved for each print material level sensing device and an undesirable reduction in signal to noise ratio (SNR) can be avoided, enabling more accurate determination of the remaining amount of print material. In an example arrangement in which the topmost sensor is closest to the node, and hence to the power source, and the bottommost sensor is furthest from the node, the remaining amount of print material can be accurately determined as the container approaches an empty state.

Figures 4A, 4B:
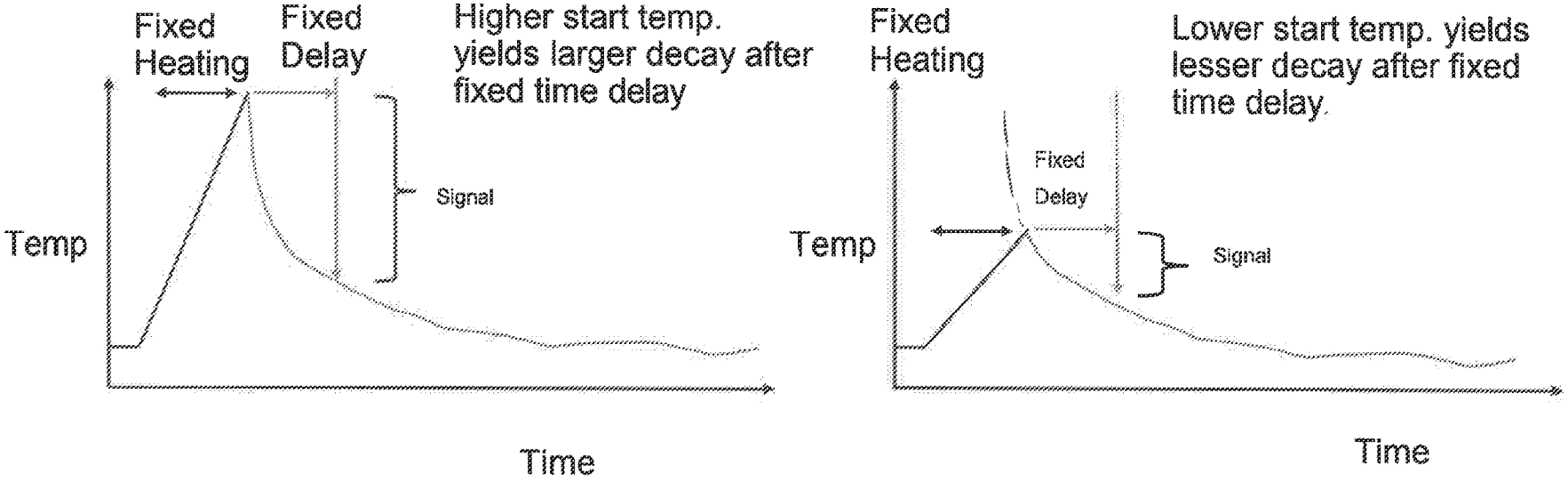
FIGS. 4A and 4B show example signal decay after heating has been stopped.

FIGS. 4A and 4B show an effect of heating a heater at a depth zone to obtain a higher starting temperature before performing measurement. If for example a measurement is made after a fixed delay time has been reached from when heating is stopped, then for a higher starting temperature a larger decay in the sensed signal may occur during the delay time. This provides more degrees of discrimination versus a depth zone that is decaying from a lower starting temperature. The circuitry therefore has a larger dynamic range to work with. The rate of decay from the starting temperature will vary depending on the heat capacity of the material present around the sensor, whereby which of print material and air is present can be determined.

Turning again to FIGS. 1 and 2, in one example the control circuitry 3 may turn on the heater 4 of each print material level sensing device 6 of a group of print material level sensing devices at depth zones closer to the power node than the first depth zone for a same time duration. In one example, sensing is performed for each of the print material level sensing devices 6 in the group in sequence from the print material level sensing device closest to the power node to the print material level sensing device of the group furthest from the power node. In this way, it is avoided to set or obtain a different time duration for each of the heaters of the print material level sensing devices of the group. For a group of sensing devices close to the power node this is possible because the effects of the parasitic voltage drops will be limited for such a group. For example, if there are more than one hundred sensing devices, the group may comprise twenty sensing devices closest to the power node.

In an example print material level sensor, the control circuitry 3 may turn on the heater 4 of each print material level sensing device 6 for a time duration set for that print material level sensing device. The set time duration may be stored by the control circuitry or obtained from an external storage or device. For example, it may be obtained by the control circuitry from a printer device. In one example, the control circuitry may receive the time duration set for a print material level sensing device from a look-up table. The look-up table may store an identifier for each print material level sensing device together with a time duration for each print material level sensing device. An example is shown in FIG. 5.

In a further example, the control circuitry 3 may turn on the heater 4 of successive print material level sensing devices 6, each at a depth zone adjacent to and further from the power node 10 than the preceding print material level sensing device, for a time duration determined as the time duration of the preceding print material level sensing device plus an incremental time amount. As an example, the incremental time amount may have a fixed value.

As an example, the incremental time amount may have the same value for each of the successive print material level sensing devices. As a further example, the value of the incremental time amount may depend on the distance between the successive print material level sensing device and the preceding print material level sensing device. In this way, if for example the print material level sensing devices are not uniformly spaced, then the incremental time amount can be made to better correspond to the parasitic voltage drop suffered by the heater of a given print material level sensing device in comparison to the heater of a preceding, i.e. closer to the powder node, print material level sensing device.

Figure 6:
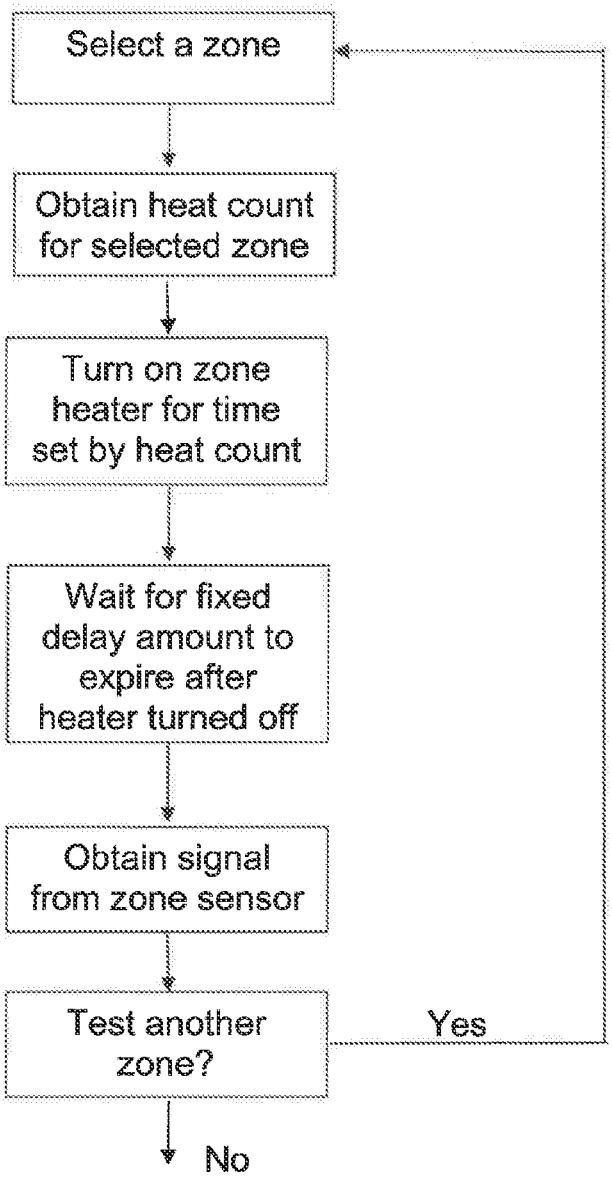
FIG. 6 shows example print material level sensing.

FIG. 6 shows an example flowchart of performing example print material level sensing. In the example, a zone to be tested is selected. The zone may be selected in accordance with a zone select signal. In one example, this may be received from an external device such as a printer. In another example, it may be generated or otherwise obtained by the control circuitry 3. For example, it may be generated by a controller of the control circuitry 3. A heat count for the selected zone may then be obtained. In one example this may be obtained by the control circuitry from a look-up table which stores a respective heat count for each zone. In one example, the look-up table may be stored in an external device such as a printer. In another example, the look-up table may be stored in a memory of the control circuitry. The heat count indicates the time duration for which the heater of the selected zone, i.e. of the selected print material level sensing device, should be turned on. The control circuitry may then control to turn on the heater of the selected zone for the time duration indicated by the obtained heat count. After the heater has been turned on for the indicated time duration, the heater is turned off by the control circuitry. In one example, the control circuitry may then wait until a fixed delay amount has been reached after the heater is turned off. After the fixed delay amount has been reached, the control circuitry may obtain the signal from the sensor of print material level sensing device in the selected zone. As an example, the delay time may be at least 10 μs. As another example, the delay time may be at least 60 μs. As another example, the delay time may be in the range of 60-80 μs. As another example, the delay time may be at least 1000 μs. In another example, the measurement may be made when enabling of the supply of electrical power to the heater is stopped. In a further example, measurement may be made before stopping enabling of the electrical power to the heater. It can then be determined whether to test another zone. For example, testing can be continued until all zones have been tested. If another zone is to be tested, then the zone may be selected in accordance with a zone select signal.

Figure 7:
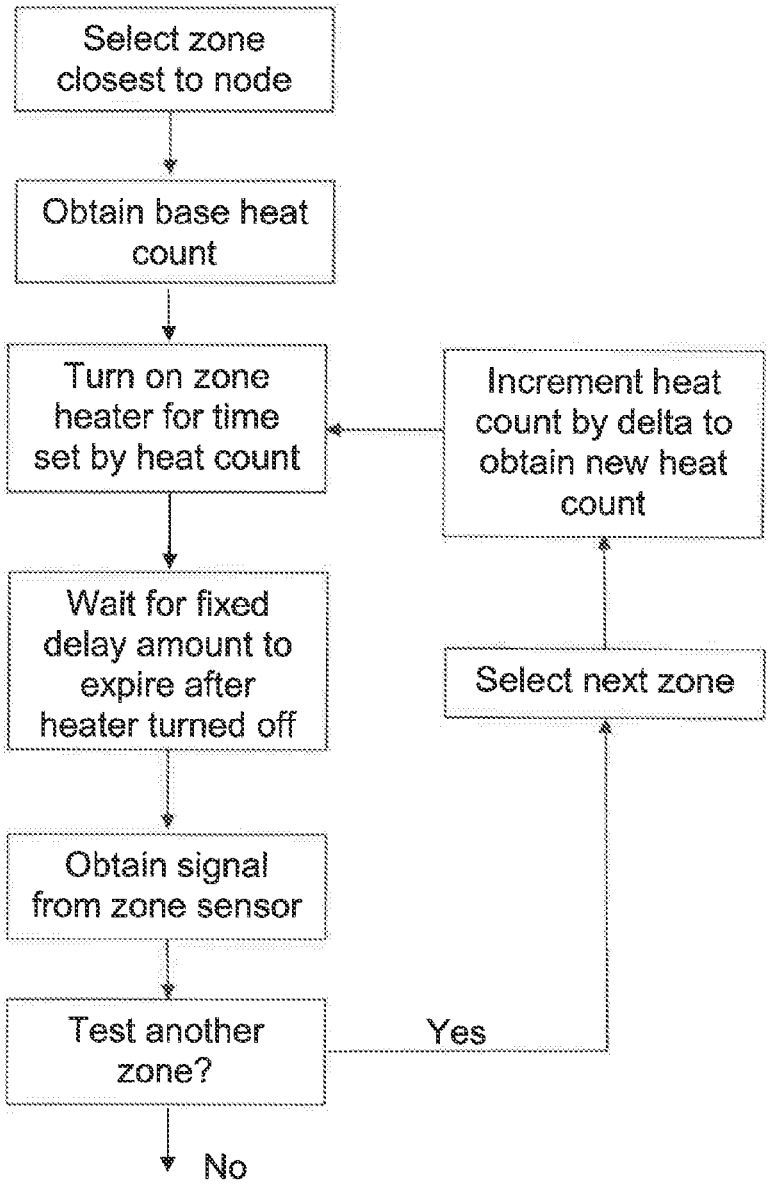
FIG. 7 shows another example of print material level sensing.

FIG. 7 shows another example flowchart of performing example print material level sensing, similar to the flowchart of FIG. 6. In the example of FIG. 7, a zone closest to the power node 10 is selected as a first zone to be tested. The zone may be selected using a zone select signal received for example from an external device such as a printer or for example generated or otherwise obtained by the control circuitry 3. A heat count for the selected zone may then be obtained. In the example of FIG. 7, the heat count may be received by the control circuitry 3 from an external device such as a printer. The control circuitry may store the heat count in a register. In the example of FIG. 7, the heat count is a base heat count indicating the time duration for which the heater of the selected zone, i.e. the heater of the print material level sensing device closest to the power node, is to be turned on. The control circuitry may then control to turn on the heater of the print material level sensing device closest to the power node for a time duration corresponding to the heat count. After the heater has been turned on for the indicated time duration, the heater is turned off by the control circuitry. As an example, the control circuitry may then wait until a fixed delay time has been reached after the heater is turned off. After the fixed delay time has been reached, the control circuitry may obtain the signal from the zone sensor, i.e. from the sensor of the print material level sensing device closest to the power node.

It can then be determined whether to test another zone. For example, another zone can be tested until it is determined that all zones have been tested. In the example of FIG. 7, a next adjacent zone may be selected as a zone to be tested. This is the zone, and hence print material level sensing device, second closest to the power node. The heat count is then incremented by an incremental amount, delta, to obtain a new heat count. The heater of the print material level sensing device of this zone is then heated for a time duration indicated by the new, i.e. incremented, heat count. After the heater has been turned on for the indicated time duration, the heater is turned off by the control circuitry. As an example, the control circuitry may then wait until a fixed delay time has been reached after the heater is turned off. After the fixed delay time has been reached, the control circuitry may obtain the signal from the sensor of the print material level sensing device in the zone being tested.

The process of FIG. 7 may be repeated until all of the print material level sensing devices have been tested. Each time a new print material level sensing device is to be tested, for example adjacent to the previously tested print material level sensing device and further from the power node, the heat count is incremented by the amount delta to increase the time duration for which the heater of the print material level sensing device is turned on. In this way, the parasitic voltage drop due to the increased length of wiring can be compensated for.

As a further example variation of the example sensing of FIG. 7, a same heat count may be used for a group of print material level sensing devices closest to the power node. For example, after the testing of the zone closest to the power node, the next zone next closest to the power node may be tested with the same heat count. This may be repeated for a number of adjacent zones forming a group of zones closest to the power node. For example, a same heat count may be used for a group of up to twenty zones, i.e. print material level sensing devices. Considering the flow chart of FIG. 7, the amount delta by which the heat count is incremented is zero within the group of zones. When the first print material level sensing device outside of the group is to be tested, i.e. further from the power node than the group, then delta can assume a positive, non-zero value. The heat count may then be successively incremented by the amount delta for each subsequent zone to be tested.

In the example of FIG. 7, incrementing of the heat count may be performed by an external device such as a printer. The control circuitry may receive the incremented heat count from the external device. Alternatively, the control circuitry may increment the heat count itself. For example, the control circuitry may include an up-counter to increment the heat count by the amount delta.

In the examples of FIGS. 6 and 7, it is described to increment the heat count as zones are tested at increasing distances from the power node 10 and hence power source. As a further example, it is possible to first test a heat zone further away from the power node and to then test heat zones closer to the power node. In this case, the heat count may be successively decremented as each zone closer to the power node is tested. For example, if the topmost zone is closest to the power node, sensing may be started at the bottommost zone with a base heat count. The base heat count may then be decreased by an amount delta to test the adjacent zone next to the bottommost zone. The heat count may then be successively decreased by the amount delta for each zone further away from the bottommost zone.

As an example of the control circuitry, the control circuitry may include a heat pulse generator 12 to receive a heat count and to output a heat pulse signal to turn on a heater of a selected print material level sensing device for a time duration corresponding to the heat count. This is shown for example in FIG. 8A.

Figure 8A:
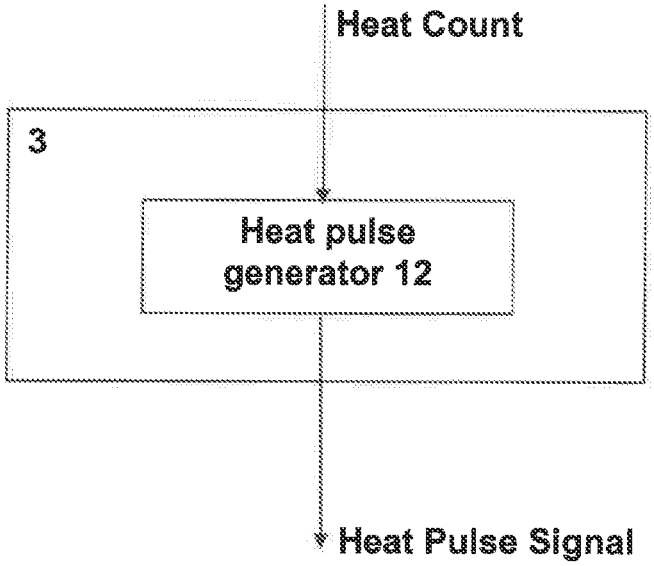
FIGS. 8A, 8B and 8C show examples of control circuitry.
Figure 8B:
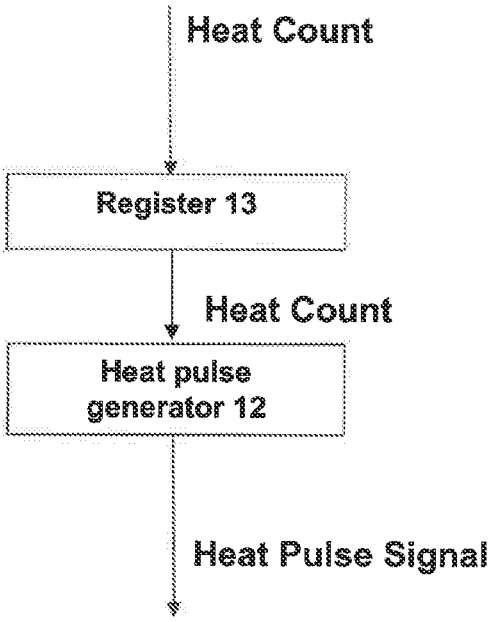
Figure 8C:
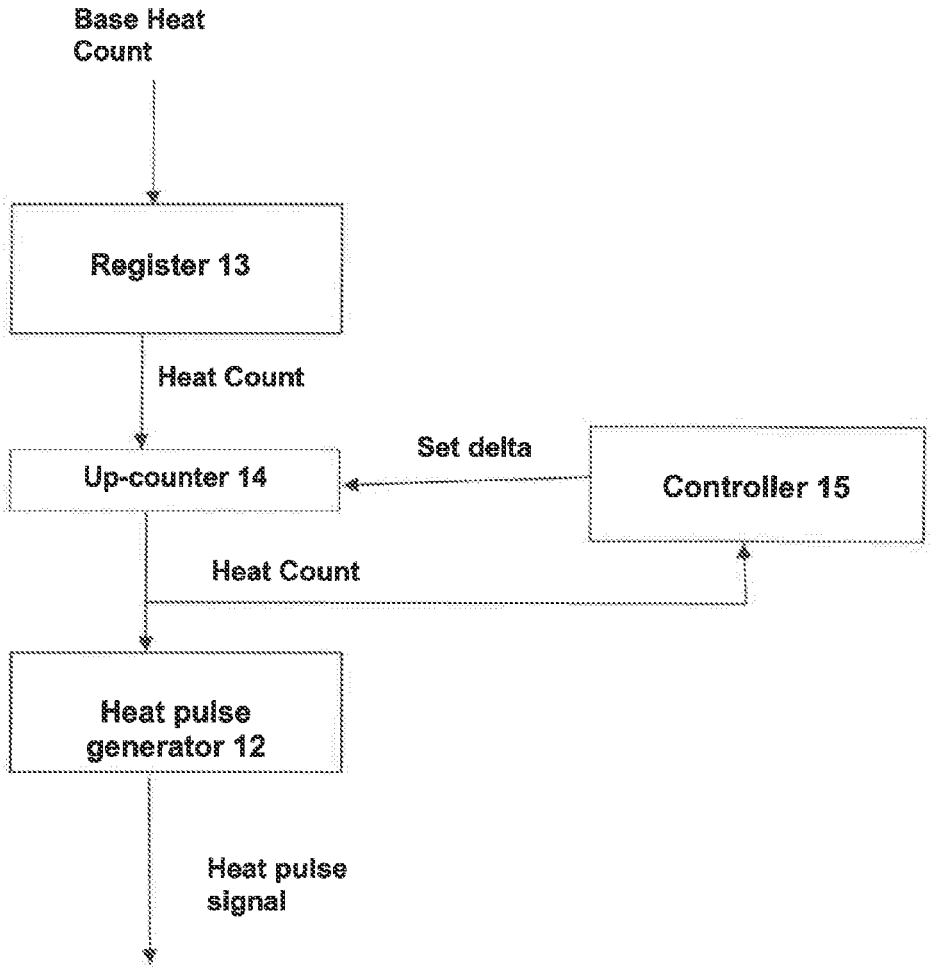

As a further example, the control circuitry may further include a register 13 to store a heat count as shown in FIG. 8B. As a still further example, the control circuitry may include an up-counter 14 to increment a heat count by an incremental heat count amount. For example, FIG. 8C shows an example in which a register can be loaded initially with a base heat count which can be incrementally adjusted by an up-counter to provide an incremented heat count to a heat pulse generator. A controller 15 may set the incremental adjustment amount delta. For example, the controller may set delta to zero to perform sensing measurement using the print material level sensing device closest to the power node. The controller may then apply a constant delta to the counter to successively increase the heat count for each subsequent zone successively further from the power node. As another example, the controller may set delta to zero for each of a group of zones closest to the power node and then apply a constant delta to successively increase the heat count for each subsequent zone successively further from the power node. As an example, the controller may be a microcontroller, CPU, processing unit or the like. It may have associated memory.

Figure 9:
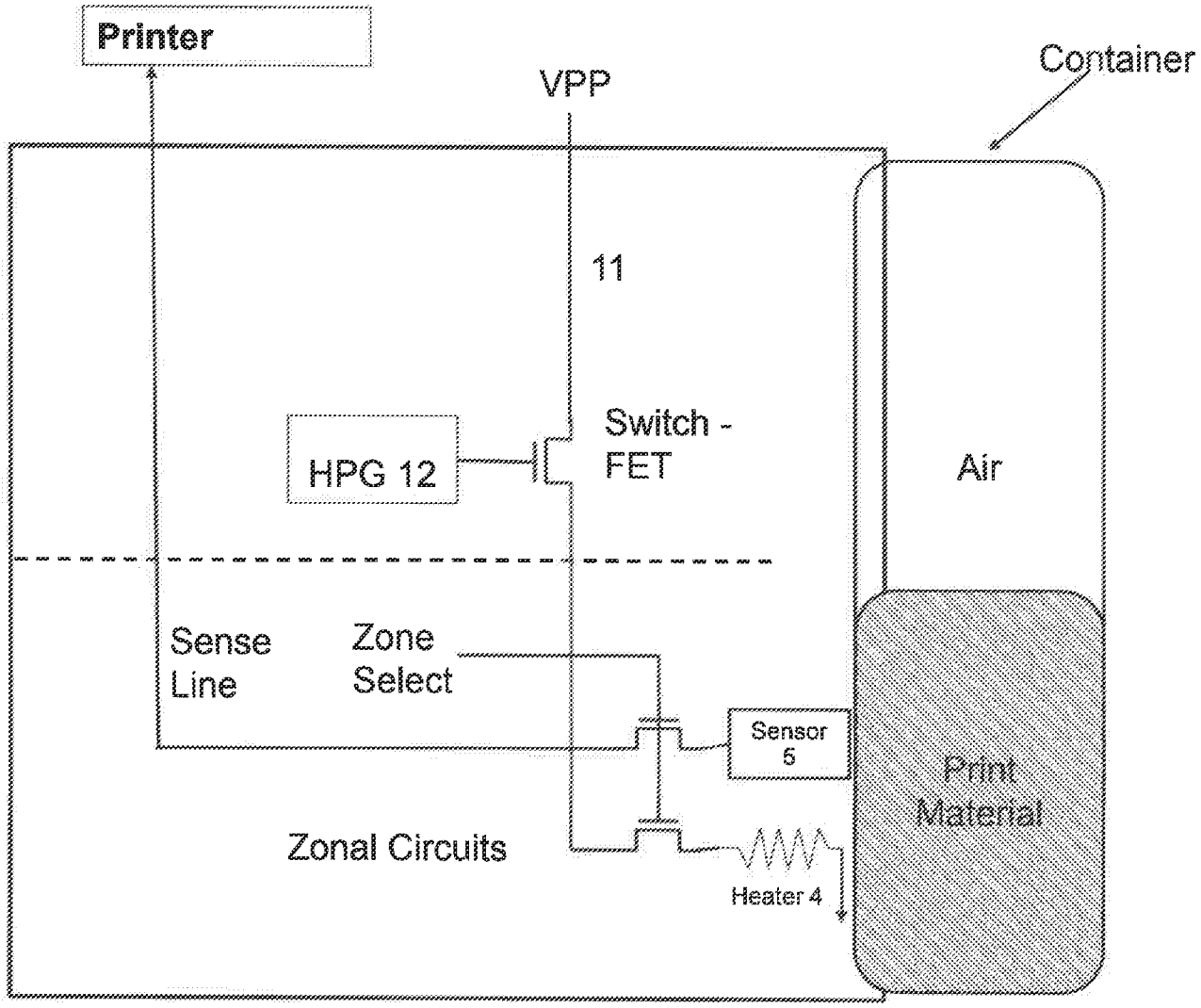
FIG. 9 shows example control circuitry.

In one example, the heat pulse signal generated by the heat pulse generator may control a switch to turn on the heater of the print material level sensing device in the selected zone. An example is shown in FIG. 9. Here the heat pulse signal generated by the heat pulse generator 12 controls a switch to provide electrical power through the wiring 11 to the heater 4 of the print material level sensing device in the selected zone. For example, the switch may be a field-effect transistor (FET) which can be enabled by the heat pulse signal. In FIG. 9, a single heater 4 and sensor 5 are depicted for simplicity. It will be appreciated that each heater 4 and sensor 5 is similarly connected to the control circuitry.

Figure 10A:
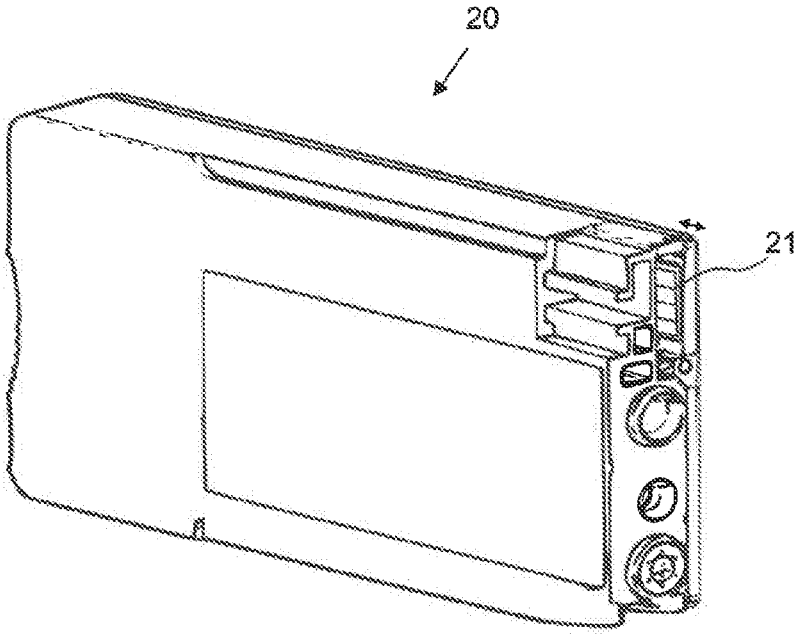
FIG. 10A shows an example print material container.
Figure 10B:
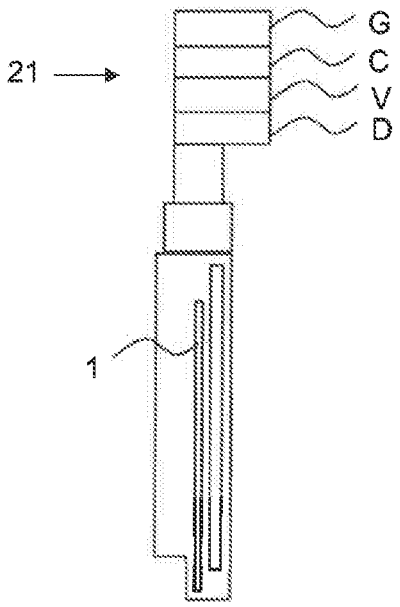
FIG. 10B shows an example print material level sensor and example electrical connection pads.

FIG. 10A shows an example print material container 20 having a print material level sensor 1 therein. The print material container 20 includes electrical connection pads 21 to connect to an electrical connector of a printer. The electrical connection pads 21 are also connected to the print material level sensor provided within the container 20. An example of a print material level sensor 1 and electrical connection pads 21 is shown in FIG. 10B. In this example, four electrical connection pads, namely a ground connection pad G, a serial clock connection pad C, a supply voltage connection pad V and a serial data input/output pad D are provided. More or fewer pads may be provided. The electrical connection pads may form a communication bus protocol, for example an $I^2C$ data interface for communication with the printer. The electrical connection pads may enable communication of signals and electrical power between the printer and the print material level sensor.

Figures 11A, 11B, 11C:
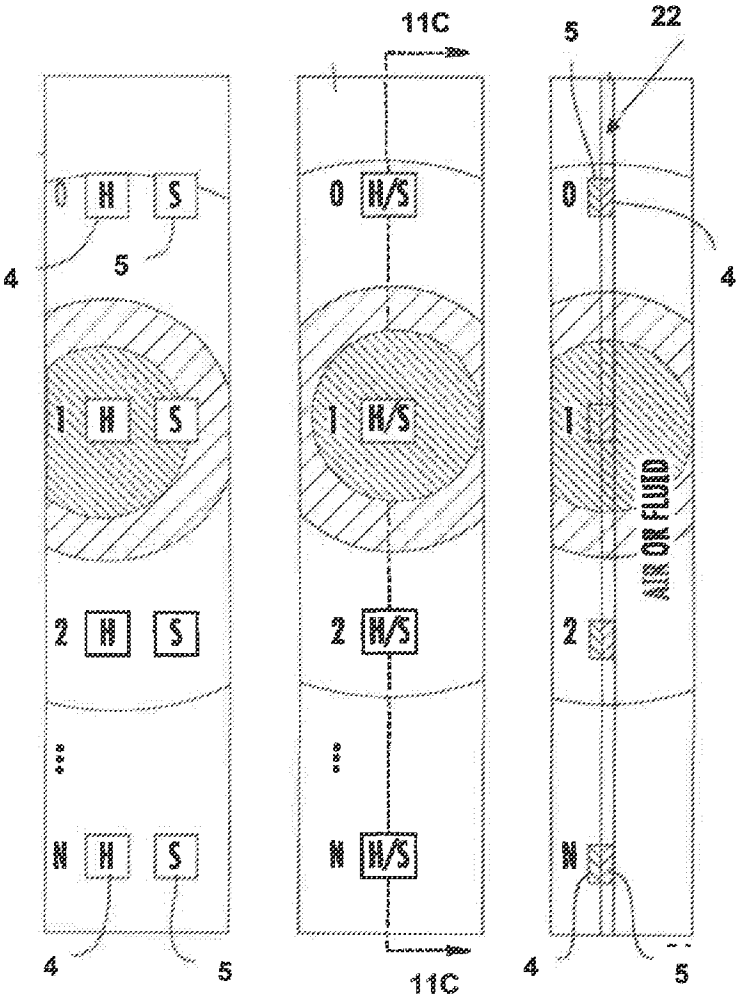
FIGS. 11A to 11C show example series of print material level sensing devices.

FIG. 2 described above shows one example of a series of print material level sensing devices. Further examples of a series of print material level sensing devices are shown in FIGS. 11A to 11C. In the example of FIG. 8A, heaters 4 and sensors 5 are arranged in pairs labelled 0, 1, 2, . . . N. Thus, the heaters and sensors are arranged in an array of side-by-side pairs. Each pair is a print material level sensing device 6.

In the example of FIG. 11B, heaters 4 and sensors 5 are arranged in an array of stacks vertically spaced. FIG. 11C is a sectional view of FIG. 11B further illustrating the stacked arrangement of the pairs of heaters 4 and sensors 5 forming the print material level sensing devices 6.

In the above described examples, a heater of a print material level sensing device may include an electrical resistor. As an example, a heater may have a heating power of at least 10 mW. As a further example, a heater may have a heating power of less than 10 W. A sensor may include a diode which has a characteristic temperature response. For example, in one example, a sensor may include a P-N junction diode. In other examples, other diodes may be employed or other thermal sensors may be employed. For example, a sensor may include a resistor such as a metal thin film resistor. The resistor may for example be located between the heater and the print material, for example by forming the resistor above the heater in a fabrication stack.

In the above described examples, a sensor of a print material level sensing device is sufficiently close to the associated heater to sense heat when the heater emits heat. For example, the sensor may be no greater than 500 μm from the heater. In a further example, the sensor may be no greater than 20 μm from the heater. As one example, the sensor may be a metal thin film resistor layer formed less than 1 μm above a heater resistor layer in a fabrication stack. In such an example, the sensor resistor layer and the heater resistor layer may be separated by a dielectric layer.

In the above described examples, there may be at least five print material level sensing devices in the print material level sensor. As a further example there may be at least ten print material level sensing devices. As a still further example, there may be at least twenty print material level sensing devices. For example, there may be at least one hundred print material level sensing devices.

In the above described examples, the heaters and sensors may be supported on an elongated strip. A strip 22 is shown in FIGS. 1, 2 and 10C. The strip may comprise silicon. The strip may have an aspect ratio, which is a ratio of its length/width, of at least 20.

To supply electrical power received from a power source to each of the heaters 4 wiring 11 may be provided. As outlined above, the wiring 11 may be in the form of one or more metal traces, such as thin film metal traces, that transmit power from the power source to the heaters. The metal traces may be formed, for example on the strip, by a silicon CMOS fabrication process. The metal traces may for example comprise aluminium. As an example, a metal trace may have a width of no greater than 100 μm. The metal trace may have a length which is at least one hundred times greater than its width. As an example, the metal trace may have a length of at least 10,000 μm.

FIGS. 11A to 11C additionally illustrate an example of pulsing of a heater 4 of a print material level sensing device 6, and the subsequent dissipation of heat through the adjacent materials. In FIGS. 11A to 11C, the intensity of the heat declines further away from the source of the heat, i.e. the heater 4 of the print material level sensing device 6. The dissipation of heat is illustrated by the change of crosshatching in FIGS. 11A to 11C.

While apparatus, method and related aspects have been described with reference to certain examples, various modifications, changes, omissions, and substitutions can be made without departing from the spirit of the present disclosure. It is intended, therefore, that the apparatus, method and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, and "a" or "an" does not exclude a plurality.

The features of any dependent claim may be combined with the features of any of the independent claims or other dependent claims.

The invention claimed is:

1. A print material level sensor, comprising:

a power node to receive electrical power;

a series of print material level sensing devices to receive electrical power from the power node and disposed at intervals to detect a presence of a print material at successive depth zones in a container, wherein each print material level sensing device includes a heater to emit heat at its depth zone and a sensor to sense heat at the depth zone; and control circuitry to turn on the heater of a first print material level sensing device at a first depth zone for a first time duration during the sensing of the first depth zone and to turn on the heater of a second print material level sensing device at a second depth zone, further from the power node than the first depth zone, for a second time duration longer than the first time duration during the sensing of the second depth zone.

2. The print material level sensor of claim 1, wherein the control circuitry turns on the heater of each print material level sensing device of a group of print material level sensing devices at depth zones closer to the power node than the first depth zone for a same time duration.

3. The print material level sensor of claim 1, wherein the second print material level sensing device is adjacent to the first print material level sensing device.

4. The print material level sensor of claim 1, wherein the control circuitry turns on the heater of a third print material level sensing device at a third depth zone, further from the power node than the second depth zone, for a third time duration longer than the second time duration during the sensing of the third depth zone.

5. The print material level sensor of claim 1, wherein the control circuitry turns on the heater of each print material level sensing device for a time duration set for that print material level sensing device.

6. The print material level sensor of claim 5, wherein the control circuitry receives the time duration set for a print material level sensing device from a look-up table.

7. The print material level sensor of claim 1, wherein the control circuitry turns on the heater of successive print material level sensing devices, each at a depth zone adjacent to and further from the power node than the preceding print material level sensing device, for a time duration determined as the time duration of the preceding print material level sensing device plus an incremental time amount.

8. The print material level sensor of claim 7, wherein the incremental time amount has a fixed value.

9. The print material level sensor of claim 7, wherein the incremental time amount has the same value for each of the successive print material level sensing devices.

10. The print material level sensor of claim 7, wherein the value of the incremental time amount depends on the distance between the successive print material level sensing device and the preceding print material level sensing device.

11. The print material level sensor of claim 1, wherein the control circuitry includes a heat pulse generator to receive a heat count and to output a heat pulse to turn a heater on for a time duration corresponding to the heat count.

12. The print material level sensor of claim 11, wherein the control circuitry includes an up-counter to increment a heat count by an incremental heat count delta and to output the incremented heat count to the heat pulse generator.

13. The print material level sensor of claim 12, wherein the control circuitry includes a register to store a base heat count to be inputted to the up-counter.

14. The print material level sensor of claim 1, wherein the series of print material level sensing devices is provided on an elongated strip having an aspect ratio of at least 20.

15. A container, comprising:

a chamber to hold a volume of print material;

a power node to receive electrical power;

a series of print material level sensing devices to receive electrical power from the power node and disposed at intervals to detect a presence of the print material at successive depth zones in the chamber, wherein each print material level sensing device includes a heater to emit heat at its depth zone and a sensor to sense heat at the depth zone; and control circuitry to turn on the heater of a first print material level sensing device at a first depth zone for a first time duration during the sensing of the first depth zone and to turn on the heater of a second print material level sensing device at a second depth zone, further from the power node than the first depth zone, for a second time duration longer than the first time duration during the sensing of the second depth zone.

16. The container of claim 15, wherein the control circuitry turns on the heater of a third print material level sensing device at a third depth zone, further from the power node than the second depth zone, for a third time duration longer than the second time duration during the sensing of the third depth zone.

17. The container of claim 15, wherein the control circuitry turns on the heater of each print material level sensing device for a time duration set for that print material level sensing device.

18. The container of claim 15, wherein the control circuitry turns on the heater of successive print material level sensing devices, each at a depth zone adjacent to and further from the power node than the preceding print material level sensing device, for a time duration determined as the time duration of the preceding print material level sensing device plus an incremental time amount.

19. A method, comprising:

turning on a first heater, at a first depth zone in a chamber holding a volume of print material, for a first time duration and then turning off the first heater;

sensing heat at a first sensor provided at the first depth zone to determine whether the print material is present at the first depth zone;

turning on a second heater, at a second depth zone further from a power node than the first depth zone, for a second time duration longer than the first time duration and then turning off the second heater, each of the first heater and the second heater receiving electrical power from the power node when it is turned on; and sensing heat at a second sensor provided at the second depth zone to determine whether the print material is present at the second depth zone.

20. The method of claim 19, wherein heat is sensed at the first depth zone after elapse of a delay time from turning off the first heater, and wherein heat is sensed at the second depth zone after elapse of the delay time from turning off the second heater.

* * * * *